United States Patent [19]

Jander

[11] 4,328,752

[45] May 11, 1982

[54] SAFETY AND ARMING DEVICE FOR A PROJECTILE FUZE

[75] Inventor: Ulf Jander, Karlskoga, Sweden

[73] Assignee: Aktiebolaget Bofors, Bofors, Sweden

[21] Appl. No.: 145,633

[22] Filed: May 1, 1980

[30] Foreign Application Priority Data

May 15, 1979 [SE] Sweden ..... 7904239

[51] Int. Cl.[3] ..... F42C 15/00

[52] U.S. Cl. ..... 102/257; 102/205; 102/272

[58] Field of Search ..... 102/204, 205, 221, 262, 102/272, 256, 257

[56] References Cited

U.S. PATENT DOCUMENTS 2,487,789 11/1949 Carr et al. ..... 102/257
2,596,171 5/1952 Robinow ..... 102/221 X
2,702,589 11/1972 Erbert ..... 102/272
3,858,516 1/1975 Robinow ..... 102/256 X
3,971,319 7/1976 Larson ..... 102/204 X
4,047,484 9/1977 Cole ..... 102/256

*Primary Examiner*—David H. Brown
*Attorney, Agent, or Firm*—Pollock, Vande Sande & Priddy

[57] ABSTRACT

A safety and arming device for an ordnance fuze for use on projectiles exposed to thermal heating by the air friction. The device comprises arming means which influenced by the heating produced on the casing of the projectile are arranged to effectuate the arming function. The arming means comprises a bimetallic strip with one end contacting the casing of the projectile and one end free to move on heating. The movement is utilized to change the safety device from its first safe position to its second armed position.

3 Claims, 3 Drawing Figures

SAFETY AND ARMING DEVICE FOR A PROJECTILE FUZE

The present invention relates to a safety and arming device for an ordnance fuze for use on projectiles exposed to thermal heating by the air friction. Specifically the device comprises arming means which influenced by the heating produced on the casing of the projectile effectuates the arming function.

The main function of a projectile fuze is to permit a safe initiation of a projectile charge. It is necessary that the fuze be safe and unarmed during transport and storing of the projectiles. In order to prevent the fuze from being actuated until a specific time after launching, projectiles are generally provided with some kind of safety and arming devices.

Such safety and arming devices generally comprise some kind of delay mechanism, for instance a pyrotechnical delay charge or an electrical delay circuit. Such delay mechanisms often require a lot of space as well as energy which is an important disadvantage especially when using small caliber ammunition.

The safety and arming devices may comprise a movable member, for instance a slide or rotor, which is arranged to assume two different positions, a safe position in which initiation of the charge is prevented, and an armed position in which the charge can be initiated.

It is an object of the present invention to provide a simple and reliable safety and arming device for projectiles of the above mentioned kind. The invention makes use of substantial heating developed on the casing of such projectiles which are passing through the air with a velocity of about 1000 m/s or more. This heating is utilized to arm the safety device. This is achieved in our invention by means of said arming means, which comprises a bimetallic strip with one end contacting the casing of the projectile and one end free to move when the strip is heated and which movement is utilized to actuate a movable member from its safe position to its armed position.

In addition to the fact that no space is required for electrical components or pyrotechnical delay charges, it is very easy in the present invention to make the safety and arming device insensitive for slow temperature changes, i.e. temperature changes of about one minute or more. Such slow temperature changes may for instance occur when storing and transporting the projectiles and such temperature changes should not initiate the charge.

Thus, in one preferred embodiment of the invention the bimetallic strip is composed of two parts having opposite moving directions. This gives rise to movement only at a rapid temperature increase as occurs when launching the projectile.

Figure 2:
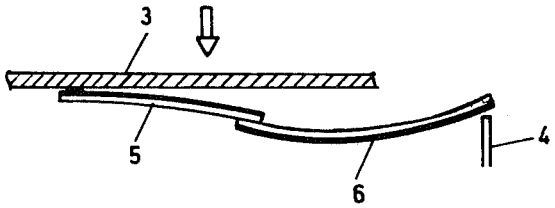
Figure 3:
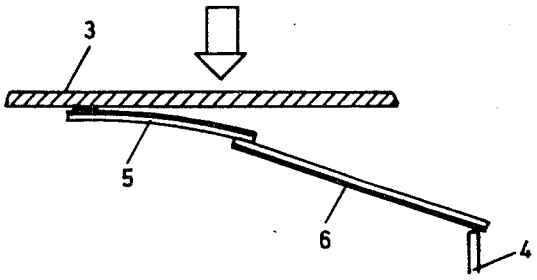

An example of the invention will now be described in more detail, with reference to the accompanying drawing which shows an advantageous embodiment of the invention at a normal temperature (FIG. 1), with slow heating (FIG. 2) and with rapid heating (FIG. 3).

Figure 1:
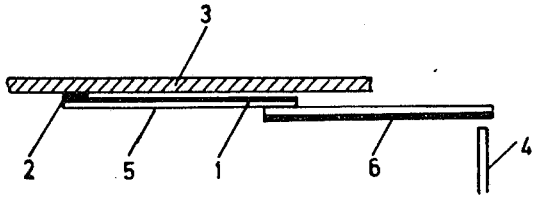

As illustrated in FIG. 1, the safety and arming device comprises a bimetallic strip 1 having one end which contacts the casing 3 of the projectile by means of a welded joint or a rivet. The other end of the bimetallic strip is free to move when the strip is heated thereby moving the slide (not shown) of the safety and arming device by means of a mechanical element 4 attached to the slide.

As further illustrated in the figure the bimetallic strip is composed of two parts 5 and 6 having opposite moving directions when heated. One of the ends of the first part 5 contacts the casing 3 of the projectile while its other end contacts the other bimetallic strip part 6. FIG. 1 shows the position of the bimetallic strip at a normal temperature in which none of the bimetallic strip parts has moved which means that no change of the slide takes place.

FIG. 2 illustrates what happens during slow heating, i.e. of about one minute or more and which, as already mentioned, may happen when storing and transporting ammunition. As illustrated in the figure heat is transmitted from the casing of the projectile to both of the bimetallic strip parts and as they have opposite moving directions, no resulting movement of the bimetallic strip takes place, and no change of the slide takes place.

In FIG. 3 the position of the bimetallic strip is shown on a rapid heating of the projectile, which happens when the projectile is launched. In this case only the bimetallic strip part 5, which contacts the casing of the projectile, has time to be heated so that a movement takes place causing the slide to be changed.

I claim:

1. A safety device for arming projectiles exposed to heat from air friction during travel, comprising:

means responsive to heat generated from air friction during travel of said projectile, said means including:

first and second bimetallic strips, one of said strips having an end contacting said projectile restricting movement of said strip in a first direction; and a second bimetallic strip having one end contacting said first metallic strip's remaining end, said strips arranged to deflect in opposite directions upon heating; and arming means for arming said projectile actuated in response to movement of said strips, said means arming said projectile as the temperature of said projectile rapidly increases as a result of said air friction forcing said strips to move.

2. A safety device according to claim 1 wherein said arming means is responsive to a remaining free end of said second bimetallic element which moves in response to heat generated by said projectile.

3. A safety device according to claim 1 wherein said first and second strips overlap for a portion of their length.

* * * * *